US007564376B2

(12) United States Patent
Jang

(10) Patent No.: US 7,564,376 B2
(45) Date of Patent: Jul. 21, 2009

(54) CONDITION-DEPENDENT ICON GENERATION FOR VEHICULAR INFORMATION TERMINALS

(75) Inventor: Yong Jae Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 365 days.

(21) Appl. No.: 11/537,922

(22) Filed: Oct. 2, 2006

(65) Prior Publication Data

US 2007/0171093 A1 Jul. 26, 2007

(30) Foreign Application Priority Data

Dec. 7, 2005 (KR) ..... 10-2005-0118516

(51) Int. Cl.
*G08G 1/123* (2006.01)

(52) U.S. Cl. ..... 340/995.1; 340/936; 340/990; 340/995.17; 340/995.27; 340/905; 701/200; 701/213; 701/220; 701/209

(58) Field of Classification Search ..... 340/438, 340/426.19, 995, 905, 936, 988; 701/213, 701/211, 220, 215, 8, 96, 110, 117, 119, 701/122, 201, 206, 208, 214, 216
See application file for complete search history.

(56) References Cited

U.S. PATENT DOCUMENTS

| | | | | |
|---|---|---|---|---|
| 6,317,689 | B1 * | 11/2001 | Lee | 701/213 |
| 6,339,745 | B1 * | 1/2002 | Novik | 701/208 |
| 6,728,605 | B2 * | 4/2004 | Lash et al. | 701/1 |
| 2002/0128774 | A1 * | 9/2002 | Takezaki et al. | 701/211 |
| 2005/0060069 | A1 * | 3/2005 | Breed et al. | 701/29 |
| 2005/0083187 | A1 * | 4/2005 | Birman et al. | 340/438 |
| 2005/0154505 | A1 * | 7/2005 | Nakamura et al. | 701/1 |

* cited by examiner

*Primary Examiner*—Daniel Wu
*Assistant Examiner*—Rufus Point
(74) *Attorney, Agent, or Firm*—Fish & Richardson P.C.

(57) ABSTRACT

In condition-dependent icon generation for a vehicular information terminal, a strength of a signal indicative of vehicle location information is measured, a road speed limit is determined based upon the vehicle location information, and vehicle speed information is received. Indicators are selected based upon the strength of the signal, the road speed limit, and the vehicle speed information, an icon is generated based upon the selected indicators, and the icon is displayed.

20 Claims, 4 Drawing Sheets

CONDITION-DEPENDENT ICON GENERATION FOR VEHICULAR INFORMATION TERMINALS

CROSS-REFERENCE TO RELATED APPLICATION

The present application claims priority from Korean Application No. 10-2005-00118516 filed Dec. 7, 2005, the entire contents of which are incorporated herein by reference.

BACKGROUND

1. Field

This document relates to a vehicular information terminal, and one particular implementation relates to the generation of an icon on a navigation system based upon conditions such as a signal strength, a road speed limit, and/or a vehicle speed.

2. Description of the Related Art

Conventional vehicular information terminals, also referred to as telematics terminals or navigation systems, typically provide mapping and other travel information via a navigation screen. Typically, a navigation screen includes a first icon that indicates the location of the vehicle, a second icon that indicates the validity and accuracy of global positioning system (GPS) signals received from a GPS satellite, and a third icon that indicates an actual moving speed of the vehicle. The icons are displayed over a map which is also displayed on the navigation screen.

SUMMARY

According to one general aspect, a strength of a signal indicative of vehicle location information is measured, a road speed limit is determined based upon the vehicle location information, and vehicle speed information is received. Indicators are selected based upon the strength of the signal, the road speed limit, and the vehicle speed information, an icon is generated based upon the indicators, and the icon is displayed.

Implementations may include one or more of the following features. For example, the vehicle speed information may be compared to the road speed limit, and selecting the indicators may further include selecting a first vehicle speed indicator if the vehicle speed information exceeds the road speed limit, and selecting a second vehicle speed indicator if the vehicle speed information is below the road speed limit. The first vehicle speed indicator may be a first color inner shape indicator, and the second vehicle speed indicator may be a second color inner shape indicator. Upper and lower signal strength thresholds may be stored, and selecting the indicators may further include selecting a first signal strength indicator if the strength of the signal is less than the lower signal strength threshold, selecting a second signal strength indicator if the strength of the signal is between the lower signal strength threshold and the upper second signal strength threshold, and selecting a third signal strength indicator if the strength of the signal exceeds the upper signal strength threshold.

The first signal strength indicator may be a first color outer circle indicator, the second signal strength indicator may be a second color outer circle indicator, and the third signal strength indicator may be a third color outer circle indicator. A road speed limit threshold may be stored, and selecting the indicators may further include selecting a first speed limit indicator if the road speed limit is below the road speed limit threshold, and selecting a second speed limit indicator if the road speed limit exceeds the road speed limit threshold. The first speed limit indicator may be a triangle-shaped inner shape indicator, and the second speed limit indicator may be an arrow-shaped inner shape indicator. A map may be displayed based upon the vehicle location information, and the icon may be displayed over the map. At least two of the indicators may have different shapes, sizes, and/or colors. The road speed limit threshold may be based upon a local highway road speed limit, such as 80 kilometers per hour or 65miles per hour. Based upon the icon, an audible output may be produced. The signal may be, for example, a global positioning system ("GPS") or an inertial reference system ("IRS") signal.

According to another general implementation, a device includes a storage medium configured to store indicators, and a receiving unit configured to receive a signal indicative of vehicle location information. A controller is configured to measure a strength of the signal, to determine a road speed limit based upon the vehicle location information, to receive vehicle speed information, to select indicators based upon the strength of the signal, the road speed limit, and the vehicle speed information, and to generate an icon based upon the indicators. The system also includes a screen display unit configured to display the icon.

Implementations may include one or more of the following features. For example, the device may also include a voice output unit configured to output a guide voice, based upon the icon, and the storage medium may be further configured to store a map that is displayed by the screen display unit. The receiving unit may be an antenna receiving global positioning system ("GPS") signals, or the receiving unit may receive an inertial reference system ("IRS") signal.

According to another general implementation, a computer program product, tangibly stored on a computer-readable medium, includes instructions to be performed by a computer. The instructions are operable to cause the computer to measure a strength of a signal indicative of vehicle location information, determine a road speed limit based upon the vehicle location information, and receive vehicle speed information. The instructions are also operable to select indicators based upon the strength of the signal, the road speed limit, and the vehicle speed information, to generate an icon based upon the selected indicators, and to display the icon.

Using this approach, a driver may avoid difficulties associated with visually filtering, identifying or recognizing relevant information, since icons are generated based upon multiple vehicle or driving conditions. Since a navigation screen may be disposed two feet or more from a driver, and the navigation screen itself may be smaller than five inches wide, and since a navigation screen is often viewed with the driver's peripheral vision, a significant advantage is garnered via the display of icons which are each indicative of a substantial amount of pertinent data.

The details of one or more implementations are set forth in the accompanying drawings and the description below. Other features will be apparent from the description and drawings, and from the claims.

BRIEF DESCRIPTION OF THE DRAWINGS

Like reference numbers represent corresponding parts throughout.

DETAILED DESCRIPTION

Figure 1:
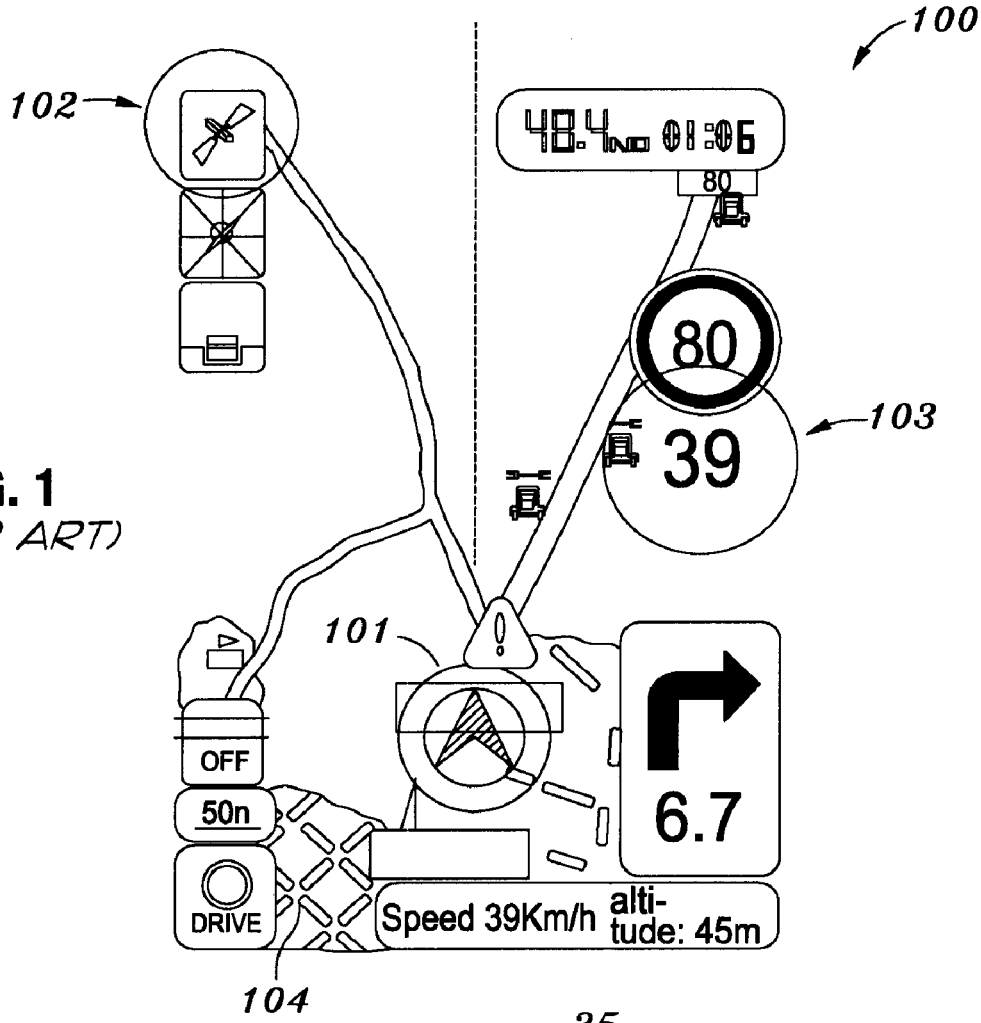
FIG. 1 (PRIOR ART)
FIG. 1 illustrates an exemplary navigation screen provided by a vehicle information terminal.

FIG. 1 illustrates one example of a navigation system that allows a driver of a vehicle to access route information to a desired destination, shown in a "full display" mode. In "full display" mode, individual vehicle conditions are displayed using multiple discrete icons. The navigation screen 100 includes a first icon 101 that indicates the location of the vehicle, a second icon 102 that indicates validity and accuracy of GPS signals received from a GPS satellite, and a third icon 103 that indicates an actual moving speed of the vehicle. The icons 101 to 103 are displayed over a map 104 which is also displayed on the navigation screen 100.

Figure 2:
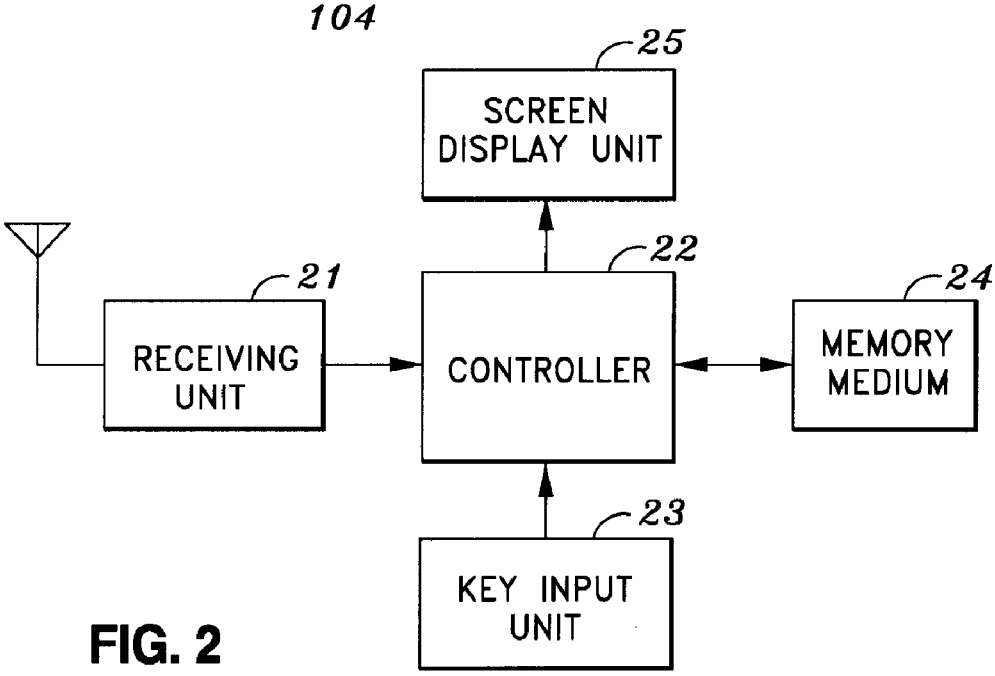
FIG. 2 is a block diagram illustrating an exemplary internal architecture of an information terminal according to one example implementation.

FIG. 2 is a block diagram illustrating an internal architecture of an exemplary information terminal. Briefly, the information terminal includes a receiving unit 21, a controller 22, a key input unit 23, a memory medium 24, and a screen display unit 25. Electronic map and other various graphic information are stored in the memory medium 24. If the electronic map information is stored on an optical recording medium such as a compact disc ("CD") or a digital versatile disk ("DVD"), a disc drive is included in the information terminal for reading the electronic map information.

The receiving unit 21 is, for example, a GPS receiving unit that receives signals transmitted from GPS satellites through a GPS antenna. The received signals are indicative of vehicle location information, in that information regarding a current location of a vehicle is calculated from the signals. Vehicle location information includes, for example, longitude, latitude, altitude, or other absolute or relative location information, where the location information is provided to the controller 22. In another implementation, the receiving unit 21 receives other types of signals, such as inertial reference system ("IRS") signals, which are also indicative of vehicle location information. The 'signal' may include one or more individual transmissions of varying quantity that can carry information from one or more sources.

The receiving unit 21 provides information regarding the signal strength (or receiving state) of received signals. Signal strengths, or indications of signal strengths (such as "no signal," "weak signal," "strong signal," or another indication) are also transmitted to the controller 22.

The controller 22 performs the navigation function on the basis of the location information provided by the receiving unit 21 using known techniques.

The controller 22 outputs a navigation screen to the screen display unit 25 when performing the navigation function, where the navigation screen displays a map and other navigation information. If controller 22 is operating in a particular enhanced display mode, referred to as a "brief display" mode, additional information is displayed via a single vehicle icon. The additional information may include information such as the receiving state of the signals, a traveling speed, a road speed limit, or other information. Since the vehicle is represented with an icon on a navigation screen, this icon can be adjusted or selected to display or represent this additional information, without separately displaying other icons. Accordingly, a larger portion of the map may be displayed to the driver, and fewer icons are used, making it easier for the driver to visually filter, identify, and recognize displayed information.

According to another implementation, screen display unit 25 further includes a voice output unit. Using a guide voice, conditions corresponding to an icon are output when requested. If an automatic voice guide mode is set, the content for the changed condition is output with a voice whenever a condition is changed, when a new icon is generated, or when an indicator is selected.

Figure 3:
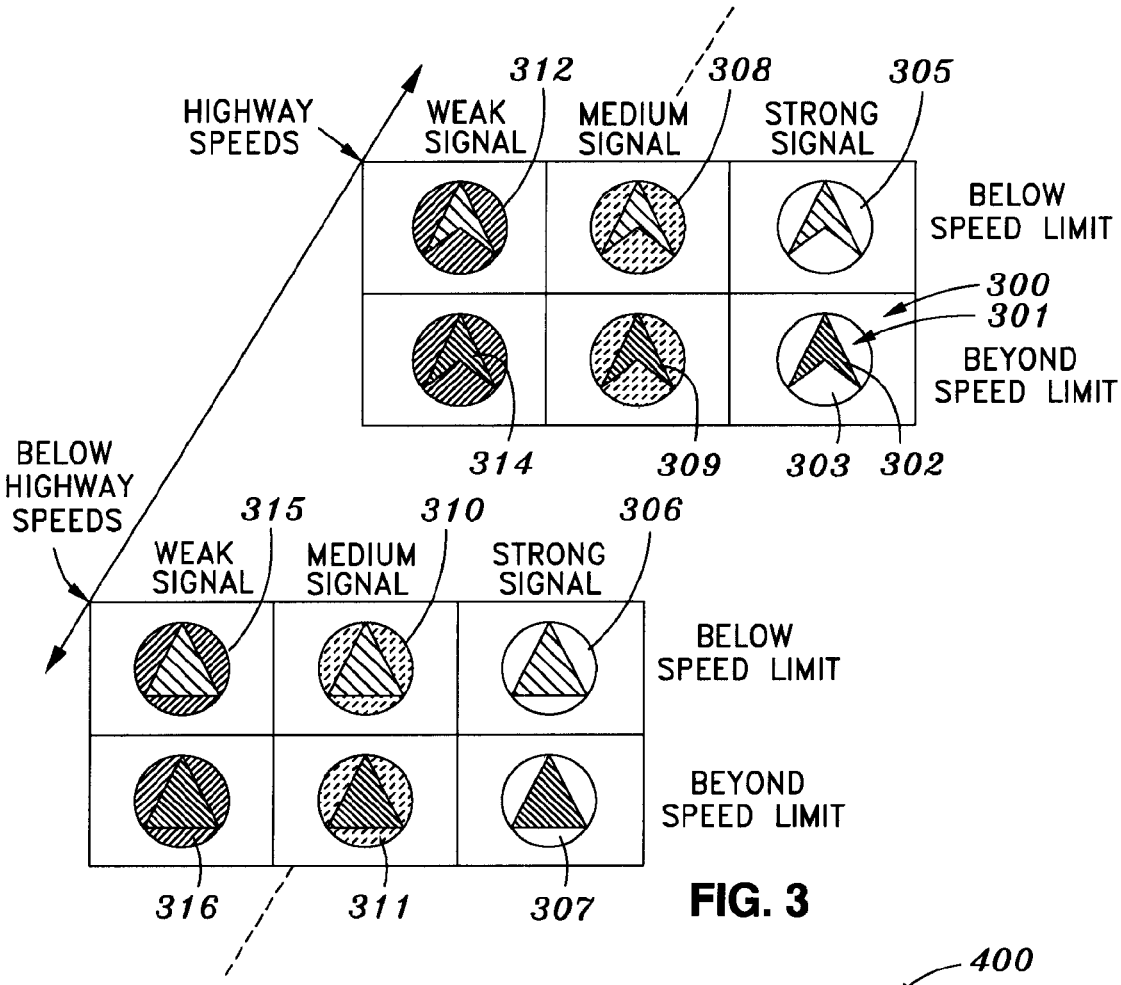
FIG. 3 illustrates several example indicators and icons capable of being selected and displayed by the information terminal of FIG. 2.

FIG. 3 illustrates several example indicators and icons capable of being selected and displayed by the information terminal. According to one implementation, the additional information stored in the memory 24 includes conditions such as a road speed limit, a signal strength, and a vehicle speed. Depending upon the state of this information, or of the state of certain information in relation to other information, an icon is generated based upon the selection of several indicators. For example, although the overall icon does not change in shape, the three indicators which comprise the icon vary based upon the information. In FIG. 3, the three indicators include an outer circular indicator which varies in color, an inner shape indicator which varies in shape, such as an arrow-shape or triangle shape, and an inner color indicator, which also varies in color. In other implementations, the indicators and icon may have different colors, shapes, sizes, or other characteristics.

In more detail, the icon 300 that represents the vehicle is composed of an internal shape indicator 301, an internal color indicator 302 filling internal shape indicator 301, and a colored circle indicator 302 circumscribing the internal shape indicator 301. The color of the circumscribed colored circle indicator 302 is based upon the signal strength of the received signals, and the color of the internal color indicator 302 is based upon whether the vehicle speed exceeds the current road speed limit. Furthermore, the shape of internal shape indicator 301 is determined, for example as a triangle shape or an arrow shape, based upon the current road speed limit.

In the FIG. 3 illustration, the colored circle indicators of icons 300, 305, 306 and 307 are a first color, indicative that a strong signal is being received. The colored circle indicators of icons 308 to 311 are a second color different from the first color, indicative that a moderate signal is being received. The colored circle indicators of icons 312 to 315 are a third color different from the first and second colors, indicative that a weak signal is being received. In one implementation based upon stoplight colors, the first color is green, the second color is yellow, and the third color is red.

Figure 4:
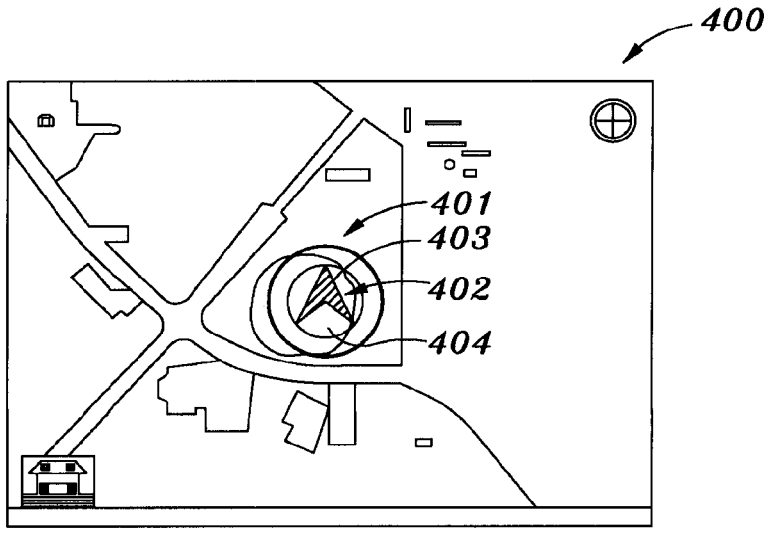
FIG. 4 illustrates a navigation screen.

If the information terminal is operated in the full display mode, such that independent icons are displayed for each condition, the driver may select the brief display mode via key input unit 23. Once the brief display mode is selected, the controller 22 displays a navigation screen such as the navigation screen 400 shown in FIG. 4. In navigation screen 400, icon 401 includes an internal shape indicator 402, an internal color indicator 403 filling internal shape indicator 402, and an outer circle indicator 404.

Conversely, if the user were to request a switch from the navigation brief display mode to the full display mode, the controller 22 generates and displays multiple independent icons indicative of the disparate conditions on screen display unit 25, as illustrated in FIG. 1. According to one implementation the key input unit 23 uses a user interface ("UI") including touch-screen key controls, or a touch pad, that allows the driver to select various functions and menus via the information terminal.

The controller 22 selects an indicator corresponding to a current condition among the indicators stored in the memory 24, based upon conditions such as the strength of the signal at receiving unit 21, a vehicle speed (which may be calculated by measuring a location displacement or change in an elapsed period of time), and a road speed limit included, for example, in the electronic map stored in the memory 24. The controller 22 also generates an icon based upon the indicators, and controls the screen display unit 25 so that the generated icon is displayed at a current location on the electronic map displayed on the screen display unit 25. Other conditions in addition to the conditions described above may also be added, or existing conditions may be omitted, as desired.

Additional indicators other than those described may also be added, or existing indicators may be omitted or altered. For instance, and in accordance with an additional arrangement which uses less memory, the data indicative of indicator shape or color may be stored instead of graphic images of the actual shape or color. Additionally, the icon may have a different shape, color or size based upon a user's request, where various alternate indicators and icons are stored in memory medium 24 for the user to select.

Figure 5:
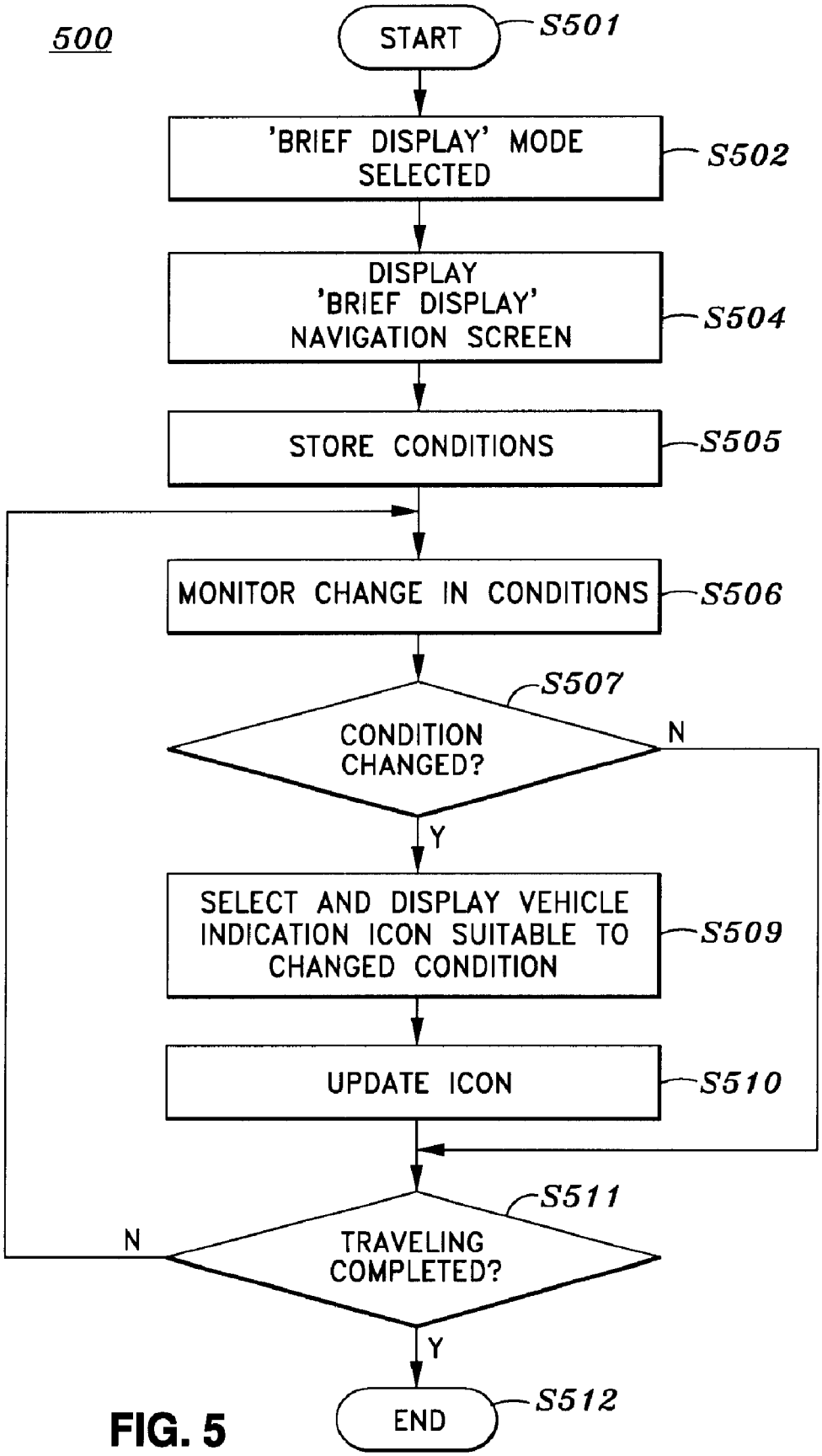
FIGS. 5 and 6 are flowcharts illustrating exemplary methods.

FIG. 5 illustrates a method 500. When method 500 begins (S501), a user selects a control to change a controller from a normal navigation mode to a navigation brief display mode (S502). A brief display mode navigation screen (illustrated as navigation screen 400) is displayed (S504). In one example, the controller 22 deletes independent icons representing additional information from a navigation screen displayed on screen display unit 25, and selects indicators suitable to a current road and traveling conditions and a strength of the received signals, selects an icon pre-stored in the memory 24, and displays the icon on the screen display unit 25, such that the generated icon represents the vehicle.

Current conditions, such as the strength or receiving state of the signal, a road speed limit, and information indicating whether the vehicle traveling speed exceeds the speed limit are received and stored (S505). Changes in the conditions are continuously monitored (S506). If any of the conditions have changed (S507), a new indicator is selected based upon the changed condition (S509), and an icon based upon the new indicator is generated and displayed (S509. For instance, if a current condition is out of range of a stored condition (S507), such as if the road speed limit changes from a highway speed limit of 65 miles per hour to a city road having a speed limit of 50 miles per hour, or if the speed of the vehicle exceeds the speed limit of the corresponding road, the controller 22 selects an indicator corresponding to the changed condition from the memory 24, generates an icon based upon the changed condition, and displays the icon on the screen display unit 25, so that the generated icon is representative of the vehicle and vehicle information.

If the icon is updated (S510), or if the condition is not changed (S507), it is determined whether traveling is complete (S511). If traveling is complete, the method 500 ends (S512). If traveling is not complete, changes in conditions are again monitored (S506). By combining various condition information into a single icon for display on a small screen of a navigation system, travel-related information is more easily recognized and processed by the driver, which enhances the overall driving experience.

Figure 6:
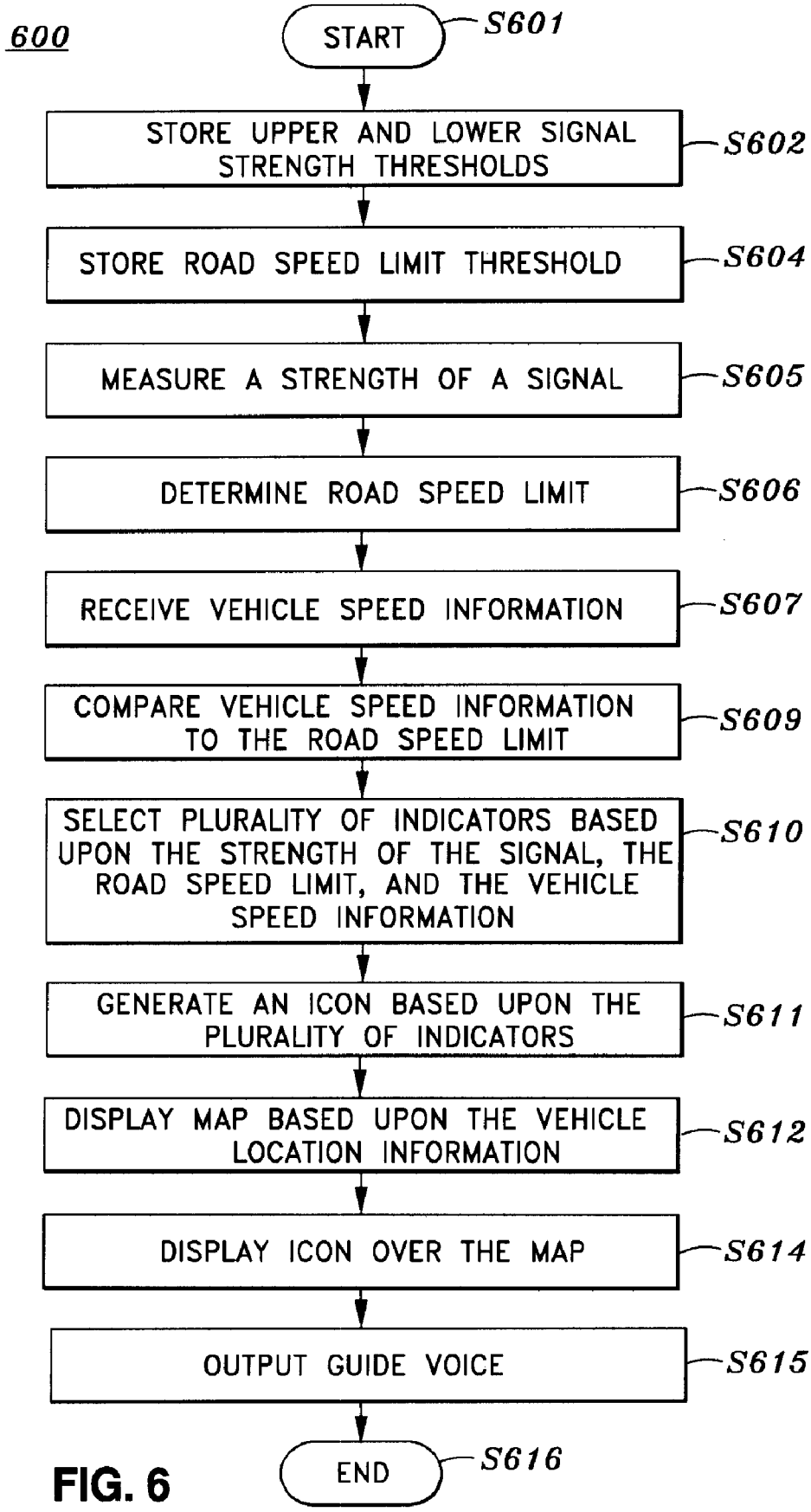

FIG. 6 illustrates a method 600 in which strength of a signal indicative of vehicle location information is measured, a road speed limit is determined based upon the vehicle location information, and vehicle speed information is received. Indicators are selected based upon the strength of the signal, the road speed limit, and the vehicle speed information, an icon is generated based upon the indicators, and the icon is displayed.

In more detail, when method 600 begins (S601), upper and lower signal strength thresholds are stored (S602). Where the strength of a signal is measured as a value, it is helpful to set and store thresholds to discriminate signals as, for example, weak signals, medium-strength signals, or strong signals. In this regard, any number of signal strength thresholds may be stored in order to help identify a signal state from a raw signal strength measurement. For example, a lower signal strength threshold may be set such that signals which are weaker than the lower signal strength threshold are classified as weak signals. As indicated above, the signal strength thresholds may be used to determine the appropriate indicator to select, and thereby to control the appearance of the resulting icon.

A road speed limit threshold is stored (S604). Where the vehicle is traveling on different road types, such as city roads or highway roads, it is helpful to set and store at least one threshold to discriminate highways or city roads, based upon speed limit. For example, and depending upon local regulations, if a certain locality sets highway speeds at 50 miles per hour or above, the speed limit threshold is stored at this value, such that any road with a speed limit above 50 miles per hour is considered a highway. As indicated above, the speed limit threshold may be used to determine the appropriate indicator to select, and thereby to control the appearance of the resulting icon.

A strength of a signal indicative of vehicle location information is measured (S605), and a road speed limit is determined based upon the vehicle location information (S606). In one example, the controller 22 determines which road the vehicle is traveling on based upon the vehicle location information, and retrieves the speed limit for that particular area of the road from map data stored in memory medium 24. For instance, using known navigation processing techniques, a controller can generate absolute Cartesian coordinates indicative of the location of the vehicle, based upon a GPS signal. The controller can compare those coordinates to a map database to determine which road the vehicle is traveling upon, and query the database to determine the speed limit for that portion of the road.

Vehicle speed information indicative of the actual traveling speed of the vehicle is received (S607). The information terminal may be physically disposed within the vehicle, in the case of a car navigation system, or it may be physically disposed at a location remote to the vehicle, such as at a fleet vehicle tracking station.

Vehicle speed information may be received in many ways, such as by manually receiving the vehicle speed information from a user, by calculating the vehicle speed information based upon positional displacement of the vehicle and elapsed time, or by automatically receiving the vehicle speed information via an information link with the vehicle. Once received, the vehicle speed information is compared to the road speed limit to determine if the vehicle is traveling below or in excess of the speed limit (S609). The result of this comparison is used to determine the appropriate indicator to select, and thereby to control the appearance of the generated icon.

Indicators are selected based upon the strength of the signal, the road speed limit, and the vehicle speed information (S610). A first vehicle speed indicator is selected if the vehicle speed information exceeds the road speed limit, and a second vehicle speed indicator is selected if the vehicle speed information is below the road speed limit. A first signal strength indicator is selected if the strength of the signal is less than the lower signal strength threshold, a second signal strength indicator is selected if the strength of the signal is between the lower signal strength threshold and the upper second signal strength threshold, and a third signal strength indicator is selected if the strength of the signal exceeds the upper signal strength threshold. A first speed limit indicator is selected if the road speed limit is below the road speed limit threshold, and a second speed limit indicator is selected if the road speed limit exceeds the road speed limit threshold.

An icon is generated based upon the selected indicators (S611). The indicators represent components of the generated icon, such that multiple items of traveling information can be discerned by viewing the one icon. In the instance where the indicators are an outer circular indicator, an inner shape indicator, and an inner color indicator, the characteristics of each indicator are assembled to generate an icon with the desired outer circular indicator and inner color indicator color characteristics, and inner shape indicator shape characteristics.

A map is displayed based upon the vehicle location information (S612), and the icon is displayed over the map (S614). If audio output is desired and selected, a guide voice is output, based upon the icon (S615), and the method 600 ends (S616).

It is understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components.

The arrangements have been described with particular illustrative embodiments. It is to be understood that the concepts and implementations are not however limited to the above-described embodiments and that various changes and modifications may be made.

What is claimed is:

1. A computer storage medium encoded with a computer program, the program comprising instructions that when executed by data processing apparatus cause the data processing apparatus to perform operations comprising:

determining a strength of a signal used for identifying a location of a vehicle;

determining a road speed limit based upon the location of the vehicle;

determining a speed of the vehicle;

selecting at least first through third appearance characteristics of a single icon that represents the vehicle on a map displayed on a navigation interface, based upon the strength of the signal, the road speed limit, and the speed, respectively;

generating the icon including the selected appearance characteristics; and displaying the icon representing the vehicle on the map of the navigation interface.

2. A system comprising:

one or more computers; and a computer-readable medium coupled to the one or more computers having instructions stored thereon which, when executed by the one or more computers, cause the one or more computers to perform operations comprising:

determining a strength of a signal used for identifying a location of a vehicle, determining a road speed limit based upon the location of the vehicle, determining a speed of the vehicle, selecting at least first through third appearance characteristics of a single icon that represents the vehicle on a map displayed on a navigation interface, based upon the strength of the signal, the road speed limit, and the speed, respectively, generating the icon including the selected appearance characteristics, and displaying the icon representing the vehicle on the map of the navigation interface.

3. A device comprising:

a storage medium configured to store a map;

a controller configured to:

determine a strength of a signal used for identifying a location of a vehicle, determine a road speed limit based upon the location of the vehicle, determine a speed of the vehicle, select at least first through third appearance characteristics of a single icon that represents the vehicle on the map displayed on a navigation interface, based upon the strength of the signal, the road speed limit, and the speed, respectively, and generate the icon including the selected appearance characteristics; and a screen display unit configured to display the icon representing the vehicle on the map of the navigation interface.

4. The device of claim 3, further comprising a voice output unit configured to output a guide voice based upon the icon.

5. The device of claim 3, further comprising an antenna configured to receive global positioning system ("GPS") signals as the signal used for identifying the location of the vehicle.

6. The device of claim 3, further comprising a receiving unit configured to receive an inertial reference system ("IRS") signal as the signal used for identifying the location of the vehicle.

7. A computer-implemented method comprising:

determining a strength of a signal used for identifying a location of a vehicle;

determining a road speed limit based upon the location of the vehicle;

determining a speed of the vehicle;

selecting at least first through third appearance characteristics of a single icon that represents the vehicle on a map displayed on a navigation interface, based upon the strength of the signal, the road speed limit, and the speed, respectively;

generating the icon including the selected appearance characteristics; and displaying the icon representing the vehicle on the map of the navigation interface.

8. The method of claim 7, further comprising comparing the speed to the road speed limit, wherein selecting the third appearance characteristic further comprises:

selecting a first internal shape indicator fill color as the third appearance characteristic if the speed exceeds the road speed limit, and selecting a second, different internal shape indicator fill color as the third appearance characteristic if the speed does not exceed the road speed limit.

9. The method of claim 7, further comprising storing upper and lower signal strength thresholds, wherein selecting the indicators further comprises:

selecting, as the first appearance characteristic, a first fill color for a region between an internal shape indicator and a circle that circumscribes the internal shape indicator if the strength of the signal does not exceed the lower signal strength threshold, selecting, as the first appearance characteristic, a second, different fill color for the region between the internal shape indicator and the circle that circumscribes the internal shape indicator if the strength of the signal exceeds the lower signal strength threshold but does not exceed the upper second signal strength threshold, and selecting, as the first appearance characteristic, a third, different fill color for the region between the internal shape indicator and the circle that circumscribes the internal shape indicator if the strength of the signal exceeds the upper signal strength threshold.

10. The method of claim 7, further comprising selecting the map based upon the location of the vehicle, wherein the icon is displayed over the map.

11. The method of claim 7, further comprising outputting a guide voice based upon the icon.

12. The method of claim 7, wherein the signal is a global positioning system ("GPS") signal.

13. The method of claim 7, wherein the signal is an inertial reference system ("IRS") signal.

14. The method of claim 7, further comprising:

receiving a first user-initiated signal to enter a brief display mode, wherein the icon is selected, generated and displayed based upon the user-initiated signal to enter the brief display mode;

receiving a second user-initiated signal to enter a full display mode; and based on receiving the second user-initiated signal:

selecting at least first through third separate icons to represent the strength of the signal, the road speed limit, and the speed, respectively, and displaying the first through third separate icons on the map of the navigation interface.

15. The method of claim 7, wherein the icon representing the vehicle is displayed on the map of the navigation interface within the vehicle.

16. The method of claim 7, further comprising selecting the map based upon the determined location of the vehicle.

17. The method of claim 7 wherein regardless of the appearance characteristic selected, the single icon representing the vehicle exhibits a circular, colored outer shape circumscribing a pointed-shaped, colored inner shape.

18. The method of claim 7, further comprising storing a road speed limit threshold, wherein selecting the second appearance characteristic further comprises:

selecting a first shape of an internal shape indicator as the second appearance characteristic if the road speed limit does not exceed the road speed limit threshold, and selecting a second, different shape of the internal shape indicator as the second appearance characteristic if the road speed limit exceeds the road speed limit threshold.

19. The method of claim 18, wherein the first shape comprises a triangle shape, and the second shape comprises an arrow shape.

20. The method of claim 18, wherein the road speed limit threshold is based upon a local highway road speed limit.

* * * * *